United States Patent [19]

LeBlanc

[11] Patent Number: 4,696,132

[45] Date of Patent: Sep. 29, 1987

[54] FOLDABLE SHELTER SYSTEM AND METHOD OF CONSTRUCTION

[76] Inventor: J. T. LeBlanc, P.O. Box 17501, Baton Rouge, La. 70893

[21] Appl. No.: 907,573

[22] Filed: Sep. 15, 1986

Related U.S. Application Data

[63] Continuation of Ser. No. 725,626, Apr. 22, 1985, abandoned.

[51] Int. Cl.[4] ..... E04B 1/344

[52] U.S. Cl. ..... 52/69; 52/71; 52/394; 52/594; 52/741

[58] Field of Search ..... 52/69, 70, 71, 238.1, 52/394, 594, 220, 741

[56] References Cited

U.S. PATENT DOCUMENTS

| | | | |
|---|---|---|---|
| 2,000,638 | 5/1935 | Hollingsworth et al. | 52/282 X |
| 2,052,757 | 9/1936 | Fitch | 52/69 |
| 2,204,319 | 6/1940 | Parsons et al. | 52/282 X |
| 2,453,918 | 11/1948 | Jansen | 52/594 |
| 2,670,986 | 3/1954 | Presnell | 52/70 X |
| 2,882,564 | 4/1959 | Couse et al. | 52/282 X |
| 2,894,290 | 7/1959 | Lundstedt | 52/71 |
| 3,076,286 | 2/1963 | Czecholinski | 52/594 X |
| 3,105,271 | 10/1963 | Sherron | 52/282 X |
| 3,146,497 | 9/1964 | Short et al. | 52/282 X |
| 3,182,769 | 5/1965 | De Ridder | 52/594 |
| 3,284,966 | 11/1966 | Bolt | 52/69 X |
| 3,813,839 | 6/1974 | Simpson, Jr. et al. | 52/394 |
| 3,975,877 | 8/1976 | Walton | 52/282 |
| 4,240,646 | 12/1980 | Scott | 52/69 X |

FOREIGN PATENT DOCUMENTS

| | | | |
|---|---|---|---|
| 516501 | 1/1953 | Belgium | 52/594 |
| 12952 | of 1855 | France | 52/536 |
| 465103 | 8/1951 | Italy | 52/594 |
| 20868 | of 1908 | United Kingdom | 52/238.1 |

*Primary Examiner*—Alfred C. Perham

*Attorney, Agent, or Firm*—Pravel, Gambrell, Hewitt, Kimball & Krieger

[57] ABSTRACT

A habitable shelter and method of construction having a continuous floor portion with a plurality of four exterior walls attached to the floor portion via a hinge means along contiguous sides, the walls movable between horizontal positions along the floor to vertical upright wall positions. There is further provided means for allowing the walls to lay parallel to the floor, with the end walls foldable atop the side walls, and a plurality of exterior walls stacked between the folded end walls for compact storage for shipment. There is further provided a plurality of corner beam members for stabilizing the walls in their upright position in interlocking fashion, and a roof member positioned atop the vertical walls for defining an angulated roof on the structure. There is further provided a plurality of interior walls which in their upright position are doweled into the floor portion and interlocked into the side walls for further support.

3 Claims, 13 Drawing Figures

FOLDABLE SHELTER SYSTEM AND METHOD OF CONSTRUCTION

This is a continuation of application Ser. No. 725,626, filed Apr. 22, 1985, now abandoned.

BACKGROUND OF THE INVENTION

1. Field of the Invention

The system and method and construction of the present invention relates to habitable structures. More particularly, the present invention relates to a structure which can be folded into a completely compact storable item, and under the novel method of construction, can be unfolded and assembled to produce a habitable structure with individual rooms, and completley weather proof.

2. General Background

In the housing industry, it is recognized that the cost of affordable permanent structures for habitation is a grave concern. Particularly in certain areas of the world, i.e., third world countries in Africa, South America, for example, there is a tremendous need for affordable housing for these densely populated areas. However, due to the lack of technological know-how, these third world countries are unable to produce, manufacture and construct reasonably engineered and priced houses for their citizens, and as a consequence, the citizens of these countries must endure through makeshift or completely substandard living conditions, or, if the government is able to, provide housing that can be manufactured in the United States or an industrialized nation, shipped to the country for construction.

There is a tremendous problem in supplying third world countries with affordable housing by industrialized nations, due to the tremendous costs in transporting such housing units via plane or boat, because of the amount of space that these units, since most are partially or fully constructed, occupy on a ship, and a tremendous cost that is involved in shipping a relatively small number of units, when in fact there is a need for thousands upon thousands of such units.

Although the idea of a portable, collapsible building is not new, the following patents were found which address certain aspects of the art:

U.S. Pat. No. 3,434,253, issued to Hatcher, entitled "Foldable Utility Building" relates to a building which is collapsible during transport or the like, but is readily assembliable into a building with a roof, side and end portions being connected by hinges. This particular patent does teach the use of a hinged roof as opposed to roof of interlocking roof panels and does not speak to the fact of having dowel interior partitions combined with tracks for placement therein.

U.S. Pat. No. 3,555,749, issued to Aitken, entitled "Collapsible Housing" also relates to a collapsible structure wherein the wall panels are interconnected to the ceiling and floor panels via a hinge means or the like. There is no discussion as to the placement of inner walls via dowel means and no language regarding the walls being hinged to the floor only. The item covered by this patent is particularly designed to be assembled and disassembled frequently having roller tracks.

U.S. Pat. No. 3,103,709, issued to Bolt, entitled "Building Structures" again relates to structures which are able to be structured in a work shop or the like and can be collapsed to a low height and a compact transportable unit. Unlike the present invention, this patent teaches the use of two hinged frames onto which panels are attached as opposed to the four hinged walls of the present invention.

U.S. Pat. No. 3,348,344, issued to Tatevossian, entitled "Transportable Building Construction With An Extendable Body Structure", relates to pre-fabricated transportable structure which can be assembled as one package. However, this patent does teach the use of roof trusses, an "accordian" type walls which slide along a track, and the use of beams in the support of the structure unlike the present invention.

U.S. Pat. No. 2,765,499, issued to Couse, entitled "Collapsible Hut" again relates to a collapsible structure which can be folded for transportation into a shipping container. This patent does teach the use of foldable floor panels and again it teaches the use of a hinged roof to itself and hinged walls while not being collapsible into the compact stackable structure as the present invention.

The following patents were also noted as being pertinent:

U.S. Pat. No. 3,922,828, issued to Ohe, entitled "Collapsible Prefabricated House";

U.S. Pat. No. 3,653,165, issued to West, entitled "Expandable Building With Telescoping Enclosures And Hingedly Connected Barriers";

U.S. Pat. No. 649,352, issued to Rector, entitled "Portable House";

U.S. Pat. No. 2,762,084, issued to Singer, entitled "Convertible Building Structure"; and U.S. Pat. No. 2,395,691, issued to Smith, entitled "Building With Folding Walls".

SUMMARY OF THE PRESENT INVENTION

A system and method of construction of the present invention solves the problem and shortcomings confronted in the art in a simple and straightforward manner. What is provided is a habitable shelter and method of construction having a continuous floor portion with a plurality of four exterior walls attached to the floor portion via a hinge means along contiguous sides, the walls movable between horizontal positions along the floor to vertical upright wall positions. There is further provided means for allowing the walls to lay parallel to the floor, with the end walls foldable atop the side walls, and a plurality of interior walls stacked between the folded end walls for compact storage for shipment. There is further provided a plurality of corner beam members for stablizing the walls in their upright position in interlocking fashion, and a roof member positioned atop the vertical walls for defining an angulated roof on the structure. There is further provided a plurality of interior walls which in their upright position are doweled into the floor portion and interlocked into the side walls for further support.

BRIEF DESCRIPTION OF THE DRAWINGS

For a futher understanding of the nature and objects of the present invention, reference should be had to the following detailed description, taken in conjunction with the accompanying drawings, in which like parts are given like reference numerals and, wherein.

DETAILED DESCRIPTION OF THE PREFERRED EMBODIMENT

Figure 1:
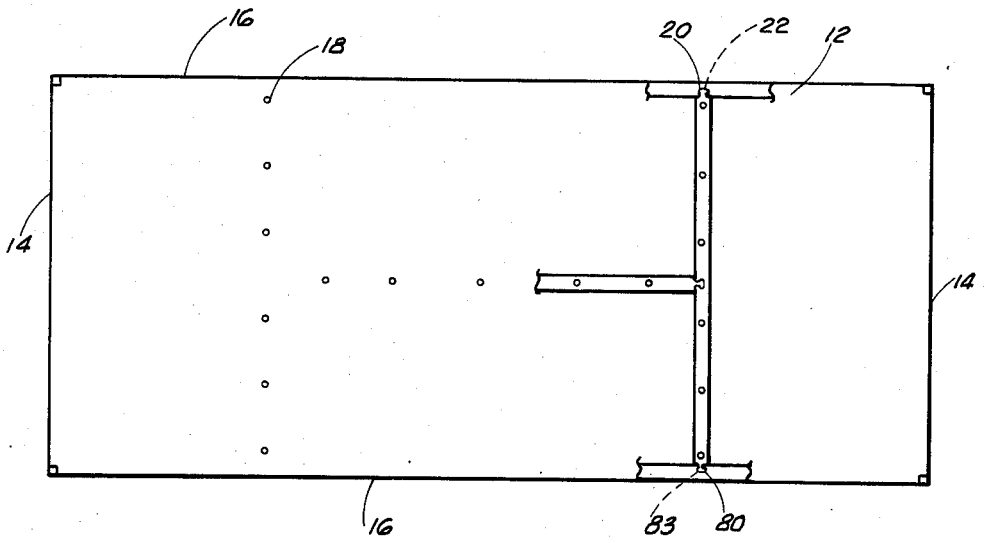
FIG. 1 is a top view of the floor portion of the preferred embodiment of the present invention.
Figure 2:
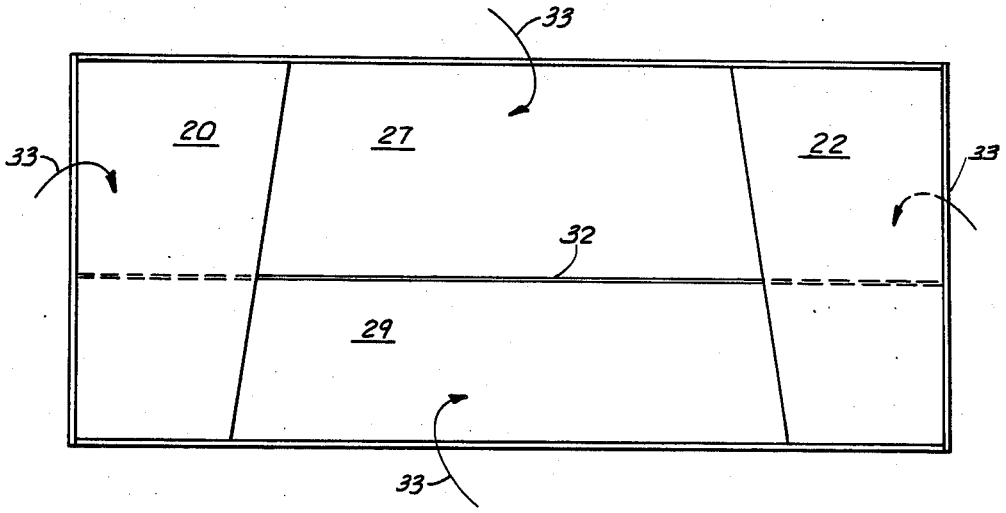
FIG. 2 is a top view of the apparatus of the present invention with walls folded onto the floor portion.
Figure 3:
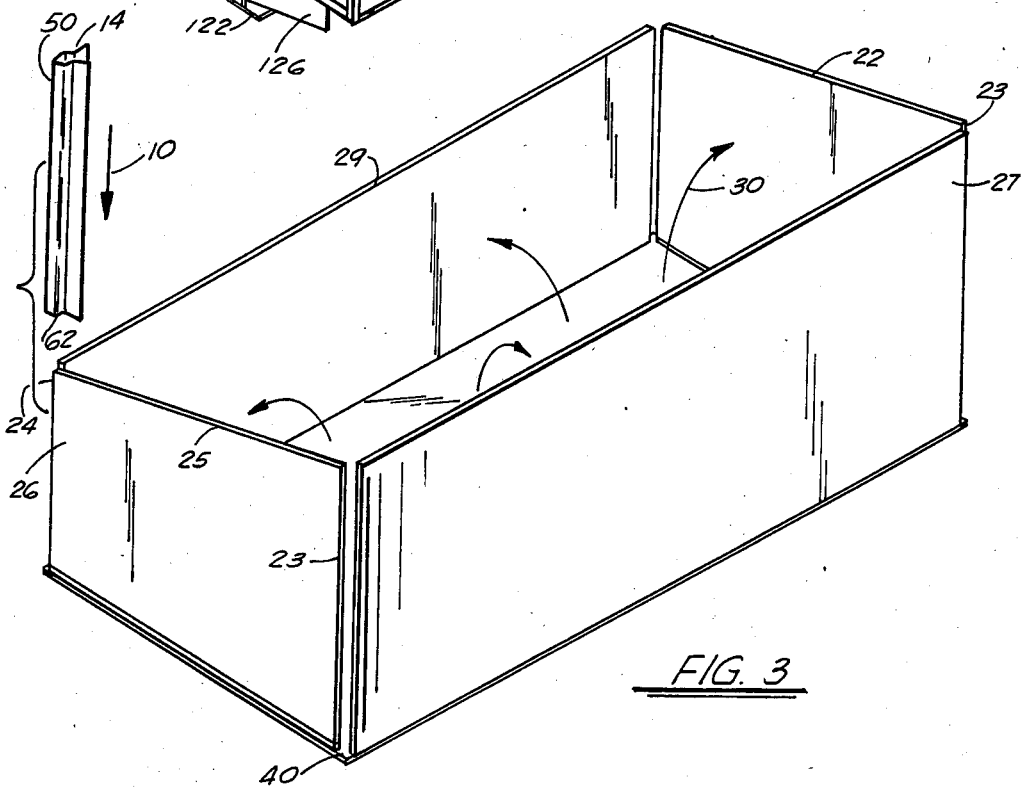
FIG. 3 is a perspective side view of the preferred embodiment of the apparatus of the present invention illustrating the walls in the vertical position.

FIGS. 1 through 10 illustrate in detail the preferred embodiment of the shelter 10 and the method of construction in the preferred embodiment of the present invention. As seen initially in FIG. 1, shelter 10 comprises floor portion 12 which is substantially rectangular floor portion, in the preferred embodiment measuring approximately 14 feet in width along side 14, and approximately 32 feet in length along side 16. As further illustrated in FIG. 1, Floor portion 12 would further comprise a plurality of dowel holes 18 which as will be discussed further, is utilized for partial support of interior walls and structure. FIGS. 2 through 5A further illustrate the exterior and interior wall construction of the shelter 10. As seen in FIG. 3, there is further provided a plurality of four exterior walls, comprising a pair of side walls 20 and 22 which are approximately 8 feet in height along their front edge 23 and approximately 6 feet in height along their back edge 24 for defining a substantially slanting top edge 25 upon which the roof of the shelter will be placed thereupon. The plurality of walls further comprise front and rear walls 27 and 29 respectively which are rectangular in shape front wall being 8 feet in height and rear wall 29 being 6 feet in height, both being substantially 32 feet in length.

As further seen in FIG. 3, arrows 30 represent the movable nature of end walls 20 and 22 and front and rear walls 27 and 29 respectively from a position substantially horizontal and adjacent to floor portion 12 as seen in FIG. 2 to the upright position, with front wall 27 occupying at least 8 feet along the width of floor portion 12 and rear wall 29 occupying substantially 6 feet along the width of floor portion 12, with the top edges of the front and rear walls 27 and 29 respectively, meeting along common edge at point 32 as seen in FIG. 2.

Figure 9:
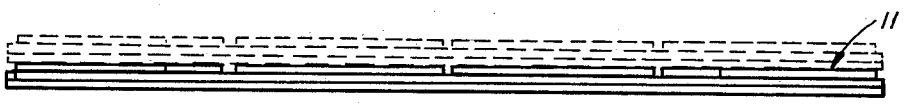
FIG. 9 is a side view of the preferred embodiment of several apparatuses of the present invention in the collapsed state for storage and shipment.

As further seen in FIG. 2, following the folding downward as illustrated by arrow 33, front and rear walls 27 and 29 respectively, side walls 20 and 22 then fold downward to substantially a parallel position along top and rear walls 27 and 29 respectively and floor 12 as seen in FIG. 2 and also illustrated by arrows 33. Thus, the four exterior walls, in their folded state defining a compact stacked structure as seen in FIG. 9 and illustrated by the numeral 11. In this state, which will be discussed further, the shelter unit 10 can be shipped easily via a ship or transport vessel wherein shape allocation is of the utmost importance.

Figure 4A:
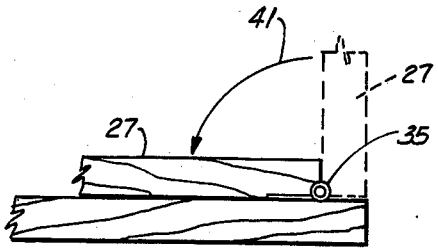
FIGS. 4 and 4A are partial cut-away perspective views of the side walls with hinged attachment means in the preferred embodiment of the apparatus of the present invention.
Figure 4:
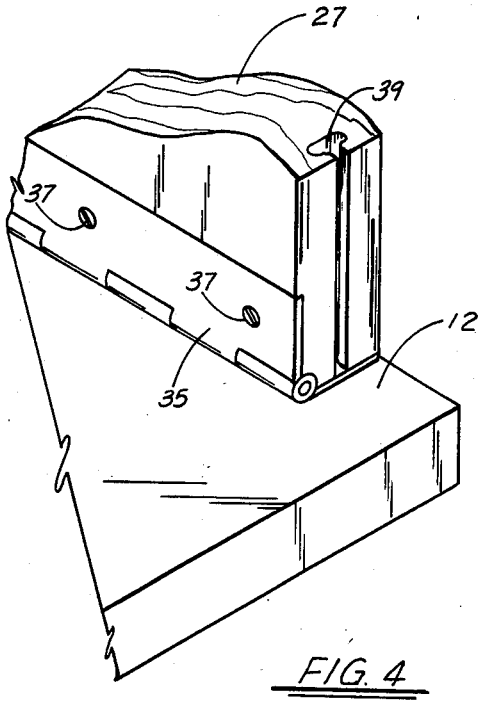

What is of the crucial inventiveness in the storagability of shelter 10 is the configuration of the attachment means whereby exterior walls 20, 22, 27 and 29 have the ability to move from vertical upright positions to horizontal storage positions. This can be more fully explained in FIGS. 4 through 5A. As seen in the FIGURES, initially side walls 27 and 29 are seen in FIGS. 4 and 4A. FIG. 4 illustrates, for example, side wall 27 as attached to floor portion 12 via a continuous hinge means 35 which is substantially a standard right angle hinge means extending along the continuous length of side wall 27, and attached to both floor portion 12 and side wall 27 via a plurality of screws or the like 37. There is further illustrated in FIG. 4 a corner post channel 39, which will be discussed further. Because of the unique hinge attachment of exterior walls 27 and 29 directly onto floor portion 12, hinged wall 27 and 29 are able to move from an upright position as seen in FIG. 4 and in phantom view in FIG. 4A to a substantially horizontal position also as seen in FIG. 4A along the path as indicated by arrow 41. Therefore, referring back to FIG. 2, one can readily see how easily side walls 27 and 29 fold into the horizontal position as seen in FIG. 2, because of the hinge means 35.

Figure 5:
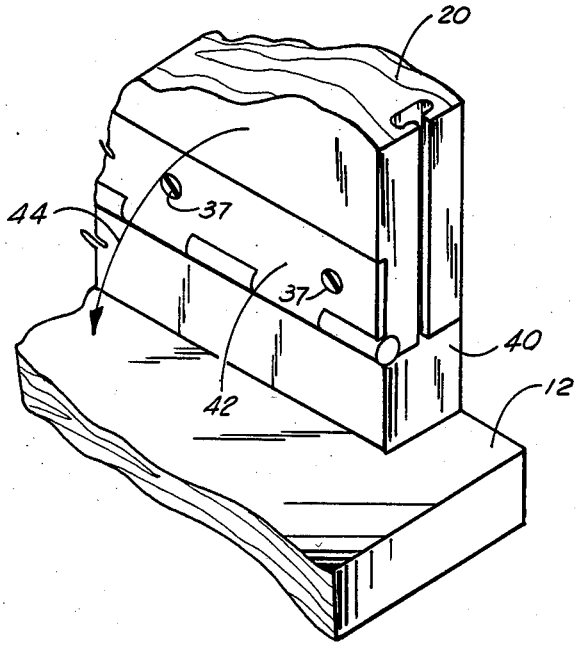
FIGS. 5 and 5A are perspective side views of the end walls and attachment means in the preferred embodiment of the apparatus of the present invention.
Figure 5A:
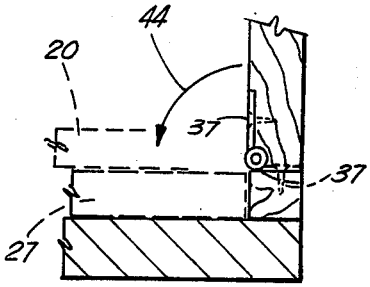

As is further illustrated in FIGS. 5 and 5A, end walls 20 and 22 likewise are movable between horizontal stacked position as seen in FIG. 2 and 9, and vertical upright position as seen in FIG. 3. However, as seen in FIGS. 5 and 5A, in order to accommodate the fact that end portions 20 and 22 must also lie completely horizontal for proper storage, accommodation must be had for the fact that end portions 20 and 22, being foldable on top of side portions 27 and 29, can not be hingeably attached along floor portion 12 as with side portions 27 and 29. Therefore, as seen in FIGS. 5 and 5A there is provided continuous mounting block 40 which is securely attached via gluing, bolting, or the like to floor portion 12 in order to provide a raised mounting means for a continuous hinge 42. As seen in the FIGURES, hinge 42 would be attached to mounting block 40 via a plurality of screws 37 also as with side walls 27 and 29, with the second wing portion of hinge 42 being likewise threadably attached via screws 37 or the like to wall portion 20 and 22. Therefore, as seen in FIG. 5A, following the folding downward of side walls 27 and 29, onto floor portion 12, with, in 5A, side wall 27 being shown in phantom view as an example, block 40 serves to positin end wall 20 and 22 substantially raised from floor 12 the thickness of side walls 27 and 29, thus providing for substantially horizontal positioning of end walls 20 and 22 as seen in phantom view in FIG. 5A via path as illustrated by arrow 44. It can be readily understood that without raised block means 40, end walls 20 and 22 could not fold substantially downward due to their conflict with the end portions of 20 and 29 in their folder state.

Figure 7:
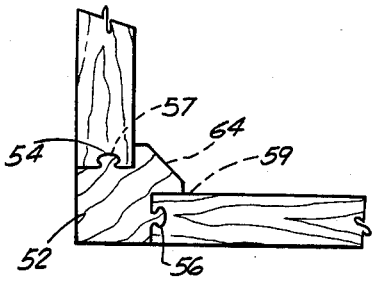
FIG. 7 is a top cross-sectional view of the cover post interlocking the side and end walls of the preferred embodiment of the apparatus of the present invention.

Although the folded positions of the end and side walls is importance in the storage and transport of the shelter, what is equally important is the shelter in its constructed state and method of construction. As was illustrated in FIG. 3, following the positioning of walls 20, 22, 27 and 29 in their respective upright positions along path 30, the exterior walls are then ready for further utilization. In order to assure that the walls are upright and firmly secured, there is provided a plurality of corner posts 50, which is illustrated in FIGS. 3 and 7, comprises a rectangular body portion 52 which is substantially equal length of the adjoining edges of the four exterior walls at their corners. Corner posts 52 further comprises a pair of locking means 54 and 56 which are accommodated into tracks 57 and 59 of each of the respective walls, with corner post 50 being insertable at the corner where exterior walls are joined by downward maneuvering of post 50 as seen by arrow 60 in FIG. 3 so that locking means 54 and 57 engage spaces 57 and 59 respectively and corner post slides downwardly unitl the bottommost portion 62 is resting on floor 12.

As seen in top view in FIG. 7, corner post 50 further comprises an interior corner portion 64 which is substantially a three-sided race for accommodating electrical wiring or the like from the floor to the ceiling. In the construction of the shelter, each corner where the exterior walls meet would be provided with a post 50 or defining a substantially rigid exterior wall configuration. Following the positioning of exterior walls in their upright position and post 50 therebetween, there is provided a standard configuration of interior wall configuration 70 as seen in phantom view in FIG. 10. In the preferred embodiment, interior wall configuration 70 would generally comprise a pair of parallel walls 71 and 73 extending substantially the width of the shelter with a substantially transverse wall 75 interposed therebetween for defining a pair of side room areas 72, 74 and a front and rear room area 76 and 78 respectively. This "H" configuration of side walls is illustrated in FIGS. 1 and 10.

For easy yet rigid accommodation of interior wall configuration 70 within the confines of exterior walls, there is initially provided, in floor portion 12 as seen in FIG. 1, a plurality of dowel holes 18, which are spaced apart so as to accommodate an equal number of dowels protruding out of the bottom edge of each interior walls 71 and 73, for insertion thereunto, assisted by gluing or the like. So that the end portions of interior walls 70 are properly mounted, like corner post 52, the edges of interior wall 70 are provided with an interlocking means 80 as seen in FIG. 1, for insertion into an accommodating locking space 82 (similar to locking means 54 and 52 between cornerpost and exterior walls) also seen in FIG. 1, into the inner side of exterior wall 27 and 29, along their entire height. Therefore, in the insertion of interior walls 70, interior wall 70 would be slid downward as was post 50, with locking means 80 engaging locking spaces 82 and upon the insertion of interior wall down into the structure, dowels 78 being inserted into dowel holes 18. Thus, all interior walls or interlocked via dowels and floor portion 12 and interlocking means 80 and 82 and side walls 29 and 27.

Figure 10:
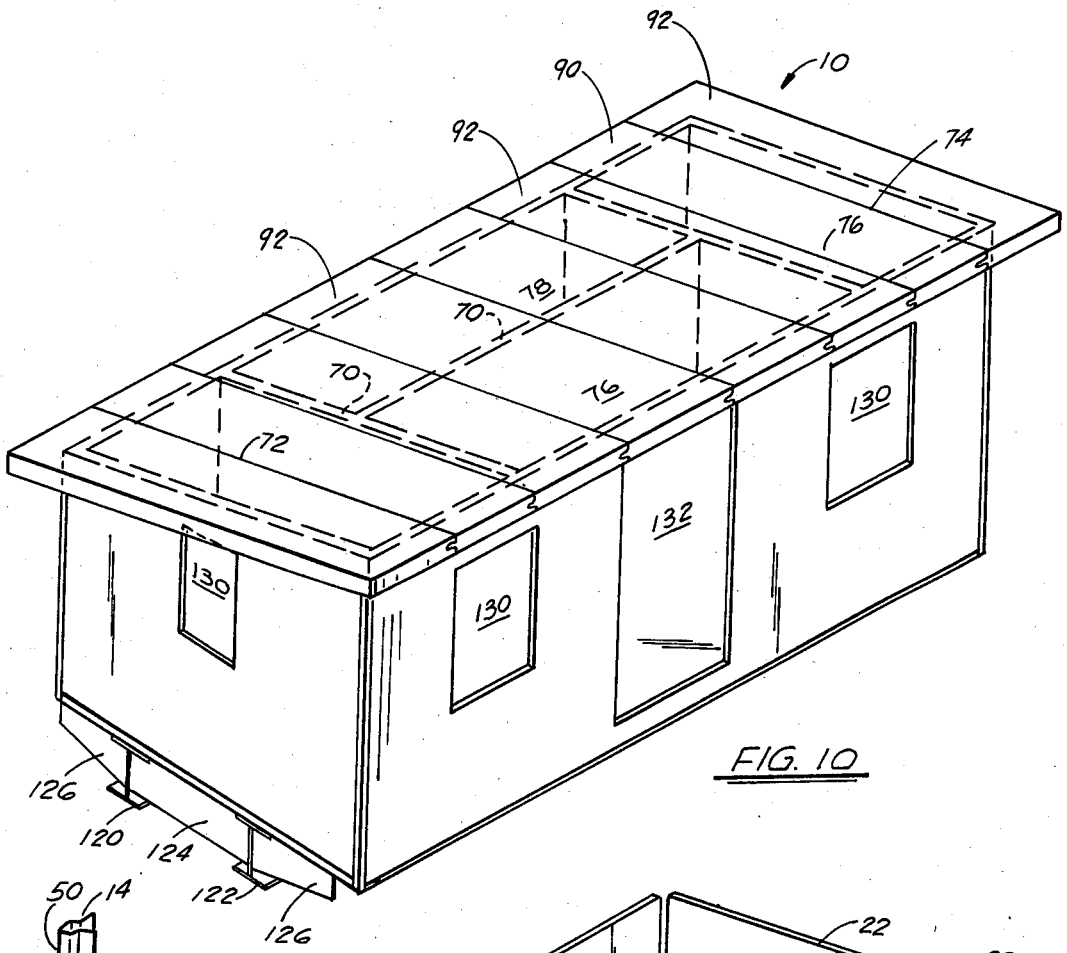
FIG. 10 is an overall perspective view of the preferred embodiment of the apparatus of the present invention in the constructed state.
Figure 6:
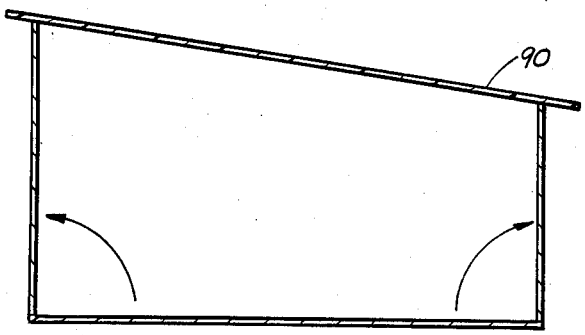
FIG. 6 is side cross-sectional view of the preferred embodiment of the apparatus of the present invention illustrating the roof placed upon the upright walls.
Figure 8A:
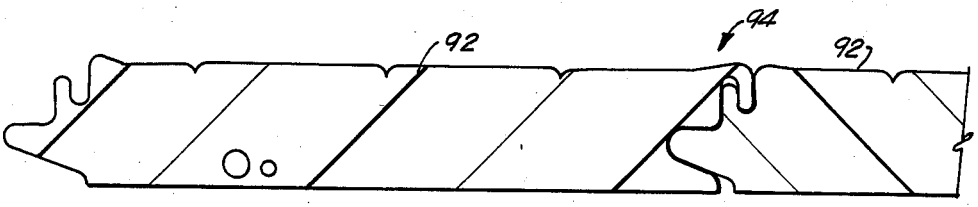
FIGS. 8 and 8A are views of the interlocking roof panels in the preferred embodiment of the apparatus of the present invention.
Figure 8:
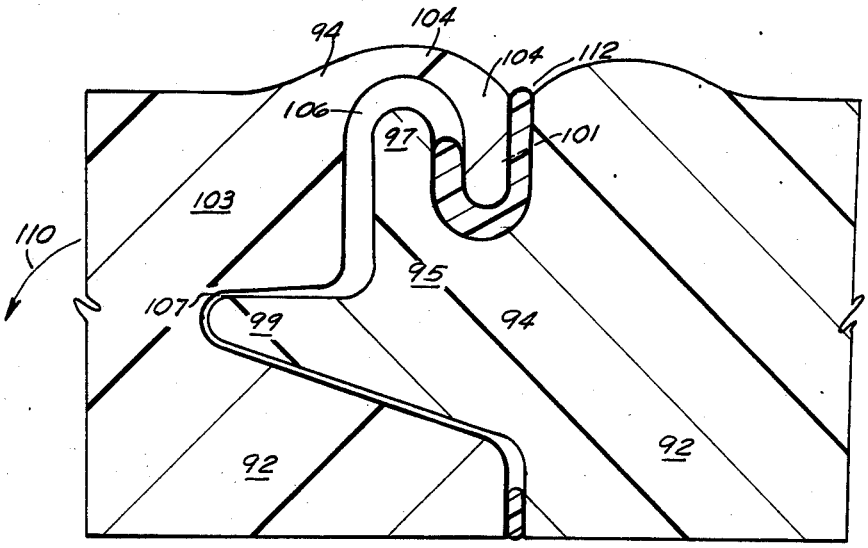

In the method of construction, following the placement of interior walls 70 within the confines of exterior walls, as seen in FIG. 10 in phantom view, the roof portion 90 is then positioned onto exterior walls as seen in FIGS. 6 and 10. As was noted earlier, due to the shorter rear wall 29 as opposed to the taller front wall 27, roof portion 90 when in position would slant to the rear thus allowing proper drainage or the like from roof portion 90 during inclement weather as seen in FIG. 6. As seen in FIGS. 8 and 8A, roof portion 90 would be comprised for the most part of a plurality of panel sections 92 which would interlock along a common edge, along the width of roof 90, with their being substantially 8 roof panels spanning the 32 foot width of shelter 10. Each roof panel 92 is interlocked onto the adjoining roof panel 92 via a first interlocking means 94 on one edge and the second interlocking means 103 on the second edge. First locking means 94 as seen in FIG. 8 comprises a main locking portion 95 which comprises a vertically disposed male member 97 horizontally disposed second male member 99 with receiving space 100 between the main body of panel 92 and male member 97. The second adjoining panel 92 would be adjoined to first panel 92 via second adjoining means 103 which would comprise an upper downwardly depending male member 104 insertable into female receiving space 100, the male member 104 defining a second receiving space 106 between itself and main body portion 103 for receiving male member 97 thereinto. It is further provided second lower receiving space 107 for receiving male member 99 of second panel 92. This interlocking of adjoining panels 92 is accomplished by initial insertion of male member 104 into space 100 and then the rotational movement of panel 92 via arrow 110 for completion of the insertion wherein male member 99 inserts into space 107 so that both panels 92 define a continuous top portion 90. In order to assure the adjoining of panels 92 is weather-proof, there is further inserted a first upper portion of flexible caulking 112 which would seal along a common edge in interspace 100, thus sealing any moisture from getting into the interlocking system. Also, along the interior common edge of 114 of panels 92, a second portion of caulking 116 is provided for closing up of any interior spacial cracks between adjoining panels 92. This system of interlocking and caulking would be provided along an entire width of adjoining panels until the roof 90 is constructed. Of course, until constructed, these individual panels could be stacked and stored as with side panels as hingedly attached to floor 12, thus providing accommodation floor space.

As seen in FIG. 10, although for the most part, when shipped to other countries, the unit would be placed in the storage position as seen in FIG. 9 and units stacked thereupon one another, there are time when the constructed unit may be hauled over highways or the like toward a less distant destination. That being the case, the constructed shelter as seen in FIG. 10 could be adapted with a system of I-beams and cross members as seen in the FIGURE whereby there would be first provided an I-beam 120 and I-beam 122 in substantially horizontal position along the exterior floor portion running the length of the shelter. These I-beams 120 and 122 would be interconnected with traverse beam 124 and a pair of outriggers 126 and 128 following the transport of the shelter, this beam network could be used as a foundation for the shelter as it would be placed on blocks or a slab, and would be easily again utilized for further transport. As seen also in FIG. 10, the exterior walls of shelter 10 can be easily accommodated even prior to shipping with a plurality fo windows 130 and door 132.

Overall, the shelter system would be constructed of lightweight yet durable composite of materials and would facilitate a tremendous increase in accommodating the vital space in transporting in cargo hulls or the like. Likewise, the easy construction of the system following its reaching a destination would require little or no construction ability, and would be easily constructed on the site where the shelter would be utilized.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A foldable shelter, comprising:

a. a substantially rectangular floor portion;

b. a plurality of wall portions hingedly attached to said floor portion movable between horizontal positions along said floor portion to upright vertical positions for supporting a roof thereupon;

c. corner post members for interconnecting the adjoining edges of the wall portions when the wall portions are in the vertical upright position, the corner post members further including an internal channel for housing electrical conduit between the roof and the floor portion;

d. means on said floor portion for accommodating a plurality of interior wall portions;

e. means on exterior wall portions for interconnecting said exterior wall portions to said interior wall portions; and f. roof means, including a plurality of panels interconnectable so that a pair of vertically disposed lip members interlock in a first position with a substantially horizontally disposed lower member positioned within a mating position in a horizontal groove, and further providing means positioned between the members to form a fluid tight seal therebetween.

2. A foldable shelter, comprising:

a. substantially rectangular floor portion;

b. a plurality of wall portions hingedly attached to said floor portion movable between upright vertical positions and horizontal positions along said rectangular floor portion;

c. at least a first pair of oppositely disposed exterior wall portions raised from said rectangular floor portion so as to provide space for folding said pair of oppositely disposed exterior wall portions from said vertical position to said horizontal position substantially parallel to and atop a horizontally disposed wall portions;

d. a plurality of corner posts slidably interconnectable with the vertical edges of said adjoining wall portions, said corner posts further including an internal raised channel or accommodating electrical wiring and conduit between the ceiling and the floor portion;

e. a plurality of port means on said floor portion for accommodating an equal numbered plurality of dowel members on the bottom edge of said interior wall portions;

f. a lip member on the vertical edge of said interior wall portions for slidably insertion into a groove in the wall of said exterior wall portion; and g. roof means connectable to said exterior wall portions, and including a plurality of panels interconnectable so that a pair of vertically disposed lip members interlock in a first position with a substantially horizontally disposed lower member positioned within a mating position in a horizontal groove, and further providing means positioned between the members to form a fluid tight seal therebetween;

said floor, said exterior wall portions and said roof means defining a habitable shelter space therewithin.

3. A method for erecting a collapsable shelter, comprising:

a. providing a substantially rectangular floor portion;

b. hingedly attaching a plurality of exterior wall portions to said floor portion, for allowing movement of said wall portions between upright and vertical positions to horizontal storage positions along said floor portion;

c. moving said plurality of exterior wall portions from said horizontal to said vertical positions;

d. providing a plurality of corner post members for slidably engaging the adjoining edges of said vertical wall portions when said wall portions are in a vertical position so that the wall portions are interconnectable to said plurality of post members define a continuous exterior wall assembly;

e. providing a plurality of ports in said rectangular floor portion for accommodating interior wall portions;

f. providing a plurality of channels in the vertical interior faces of said wall portions in alignment with said plurality of ports in said floor portion;

g. providing interior wall portions, each of said wall portions including a locking member on each vertical edge of said wall portion and a plurality of dowel members along the bottom edge of said interior wall portions;

h. inserting each locking member into said channel in said exterior wall portions and sliding said interior wall portions to a position so that said dowel in the lower edge of said wall portions are fitted into said plurality of ports in said floor portions, said inserted wall portions forming at least a pair of interior room spaces; and i. placing and securing a roof means onto said upper portions of said exterior wall portions said roof means further comprising a plurality of panels interconnectable so that a pair of vertically disposed lip members interlock in a first position with a substantially horizontally disposed lower member positioned within a mating position in a horizontal groove, and further providing means positioned between the members to form a fluid tight seal therebetween, for defining an inhabitable shelter space therewithin.

* * * * *